United States Patent [19]

Kushner et al.

[11] 4,184,661

[45] Jan. 22, 1980

[54] DISCONNECTABLE COUPLING FOR A SPLIT SYSTEM AIR CONDITIONER

[75] Inventors: Gerald J. Kushner; Edward Raleigh, both of Louisville, Ky.

[73] Assignee: General Electric Company, Louisville, Ky.

[21] Appl. No.: 772,657

[22] Filed: Feb. 28, 1977

[51] Int. Cl.[2] ..... F16K 31/02; F25D 19/00

[52] U.S. Cl. ..... 251/82; 62/292; 62/299; 251/129; 251/318; 137/DIG. 2

[58] Field of Search ..... 62/77, 292, 298, 299, 62/326; 137/119, DIG. 2; 251/82, 318, 129

[56] References Cited

U.S. PATENT DOCUMENTS

| | | | |
|---|---|---|---|
| 834,627 | 10/1906 | Longacre | 251/129 |
| 1,435,396 | 11/1922 | Howland | 137/DIG. 2 |
| 1,515,353 | 11/1924 | Martin | 251/129 |
| 1,703,311 | 2/1929 | Litle, Jr. | 62/299 |
| 2,512,090 | 6/1950 | Cooper | 62/292 |
| 2,667,760 | 2/1954 | Curtis | 62/299 |
| 2,934,915 | 5/1960 | Morse | 62/299 |
| 3,042,074 | 7/1962 | Graybill | 137/119 |
| 3,144,038 | 8/1964 | Stilwell | 137/119 |
| 3,208,232 | 9/1965 | Madison et al. | 62/292 |
| 3,645,495 | 2/1972 | Aymar | 251/129 |

*Primary Examiner*—Martin P. Schwadron
*Assistant Examiner*—G. L. Walton
*Attorney, Agent, or Firm*—Frank P. Giacalone; Radford M. Reams

[57] ABSTRACT

A valve assembly providing a disconnectable coupling for a split system air conditioner including an indoor unit and an outdoor unit joined by connecting tubing to complete the sealed refrigerant system. The present valve is effective in providing a disconnect system between a unit and the connecting tubing. The valve is activated by an electric coil that is applied to the valve only during the disconnecting procedure.

8 Claims, 3 Drawing Figures

DISCONNECTABLE COUPLING FOR A SPLIT SYSTEM AIR CONDITIONER

BACKGROUND OF THE INVENTION

This invention relates to a disconnectable arrangement for what is commonly referred to as a split system central air conditioner, wherein the evaporator or indoor heat exchanger section is arranged in an air flow arrangement with the area to be conditioned or cooled, while the condenser or outdoor heat exchanger section including the compressor is arranged outside of the area to be air conditioned. The indoor and outdoor sections are connected by conduits to complete the hermetic refrigeration circuit. It is common practice to purge and pre-charge the indoor and outdoor sections with the proper amount of refrigerant and to seal the ends to maintain the charge at the time the sections are manufactured. The connecting tubing or conduits are generally fabricated in a variety of lengths and, like the indoor and outdoor sections, are pre-charged with refrigerant and the ends sealed.

The indoor and outdoor sections and connecting tubings are shipped in their charged and sealed condition. At the time the indoor and outdoor sections are installed, the refrigeration circuit is completed by connecting the conduits to the terminal ends of the units and, accordingly, the protective seals installed at the factory must be removed or punctured without excess loss of refrigerant.

Provision must be made to prevent the refrigerant charge from escaping from the sections and tubing when the connections are made to complete the refrigerant circuit. Some manufacturers provide cooperating portions on the terminal ends of the sections and tubing that break a seal during the connecting procedure to allow the connections to be made without the loss of refrigerant. In many instances, this arrangement consists of a diaphragm on one portion being penetrated by a sharp plunger or finger on the other portion as the connection is made. This approach has proven to be a convenient and successful way of preventing excessive loss of refrigerant during the time the sections are connected to complete the refrigeration circuit of the system.

When it is necessary to break the connections, refrigerant would be lost unless provisions are made independent of the means that prevented loss of refrigerant at the time the connections were made since those are generally what is commonly called one-shot devices in the field and, accordingly, leakage past the punctured diaphragm will cause refrigerant loss.

Some manufacturers provide a valve arrangement in the outdoor section. The arrangement consists of a valve in the discharge line, and one in the suction line of the compressor.

When the circuit is to be broken or the indoor section disconnected from the outdoor section, the valve in the discharge line of the outdoor section is closed. The compressor is turned on so that most of the refrigerant returns to the compressor. After the person disconnecting the line is satisfied by watching a gauge, if necessary, that the refrigerant charge is in the outdoor section, he closes the suction line valve and traps the refrigerant charge in the outdoor section including the outdoor heat exchanger and compressor. It should be noted that in this disconnecting procedure when the line is broken any refrigerant charge not in the outdoor section is lost.

This system works reasonably well; however, the valve required to carry out the storage of refrigerant is relatively expensive in that it generally is a machined component. As a result, some manufacturers do not install the valve in their units, while others may install it only in these more expensive units.

Isolating the refrigerant as required when the above described valve is employed presents another problem. For example, the section to be replaced or repaired because of compressor malfunction is generally the outdoor section and, accordingly, all of the refrigerant charge originally placed in both the indoor and outdoor circuit is lost.

Accordingly, it is an object of the present invention to provide a valve arrangement whereby selective portions of the refrigerant circuit may be isolated, preventing the loss of refrigerant charge.

Another object of the invention is to provide a valve that can be economically applied in a plurality of selected portions of the refrigerant circuit.

SUMMARY OF THE INVENTION

By the present invention, there is provided a valving arrangement for split system refrigerant circuits having an indoor and outdoor section, and more particularly to a valve assembly for providing a disconnectable coupling between the units and the connecting tubing. The valve assembly comprises a valve body having a passageway between an inlet and outlet, and a valve retaining area arranged for accommodating a ball valve below the passageway. Actuating means are associated with the retaining area for moving the ball valve into the passageway so that the valve is moved into a closed position on a valve seat arranged between the retaining area and the outlet of the valve when refrigerant flow is present in the passageway.

DESCRIPTION OF THE PREFERRED EMBODIMENT

Figure 1:
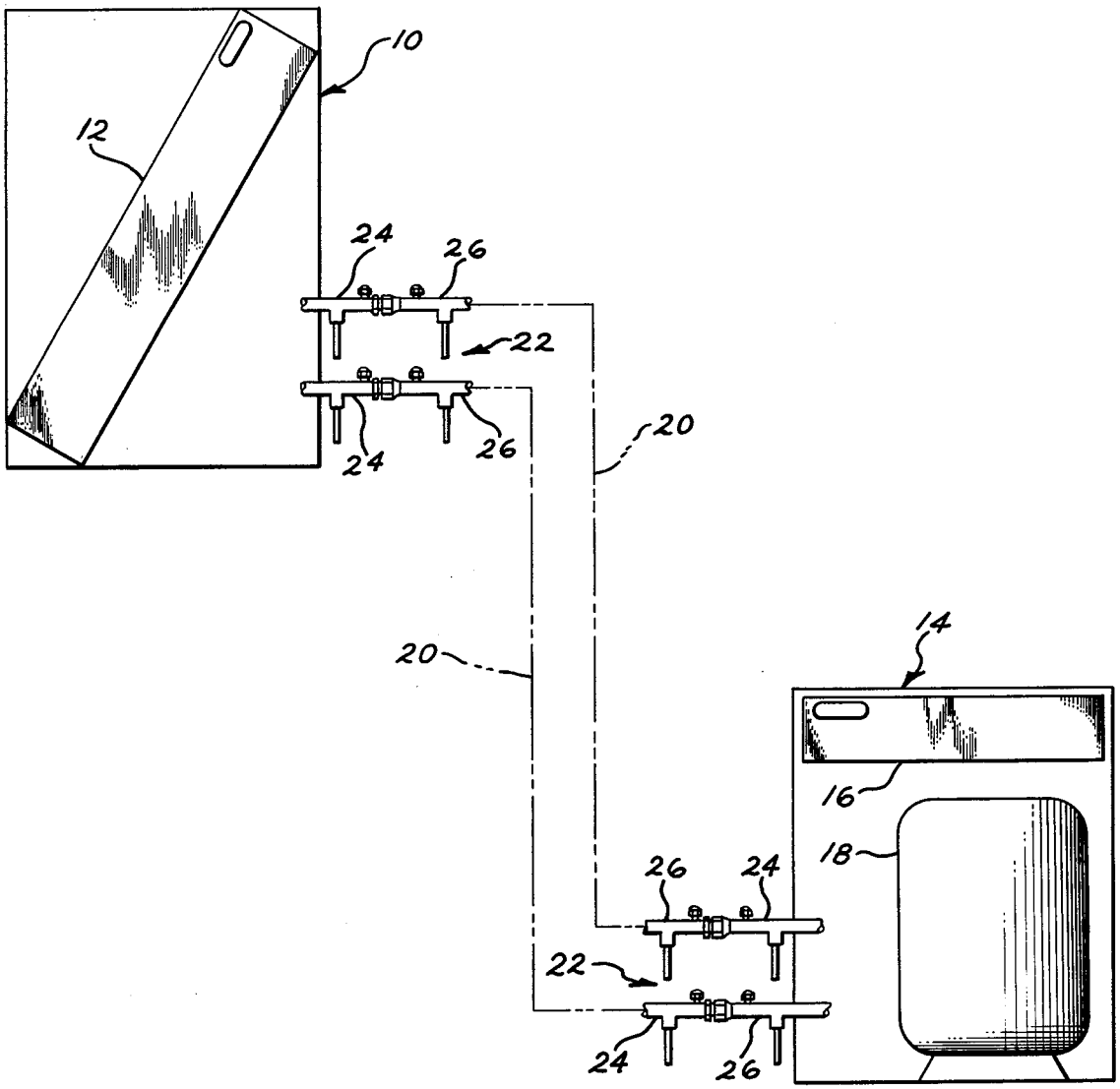
FIG. 1 is a schematic diagram of a refrigeration system with the valves of the present invention connected to complete the system.

Referring now to the Drawings and more particularly to FIG. 1 thereof, the present embodiment of the valve assembly and disconnecting system is shown applied to a sealed split refrigeration system. It should be noted, however, that other applications may be appropriate wherever it may be advantageous to disconnect portions of a pressurized sealed system without evacuating the entire system.

The split refrigeration system shown in FIG. 1 includes an indoor section or unit 10 housing an evaporator or indoor heat exchanger 12, an outdoor section or unit 14 housing a condenser or outdoor heat exchanger 16, and a compressor 18, with the inlet and outlet ends of units 10, 14 being interconnected by appropriate tubing or conduit 20.

Figure 2:
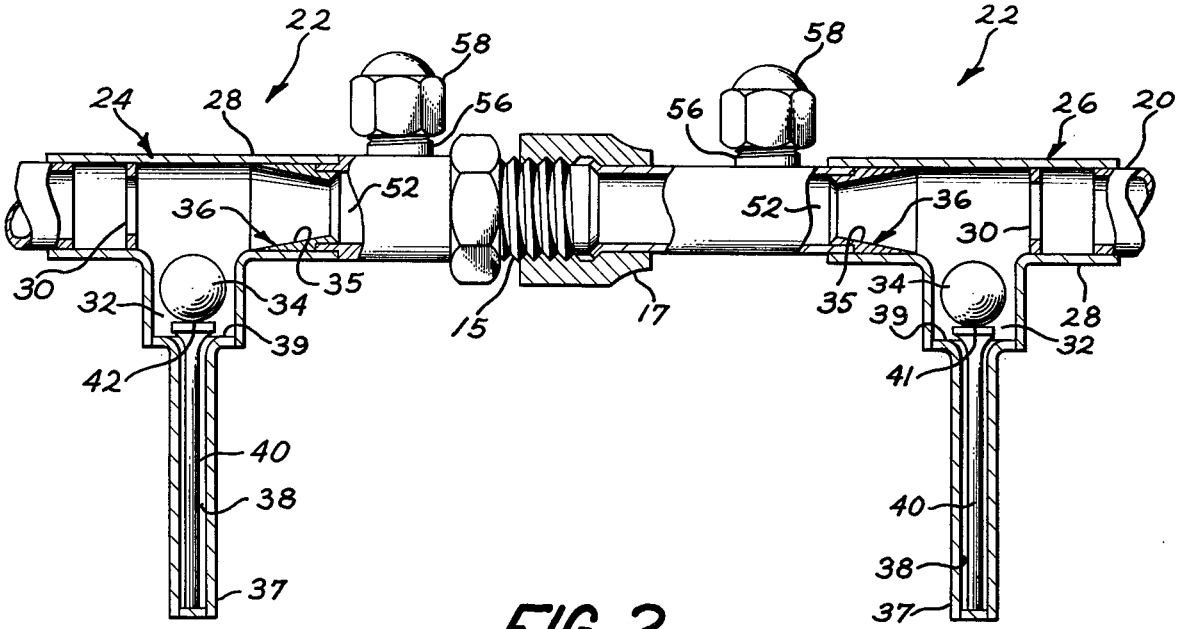
FIG. 2 is a detailed elevational view in section showing the details of a connection.
Figure 3:
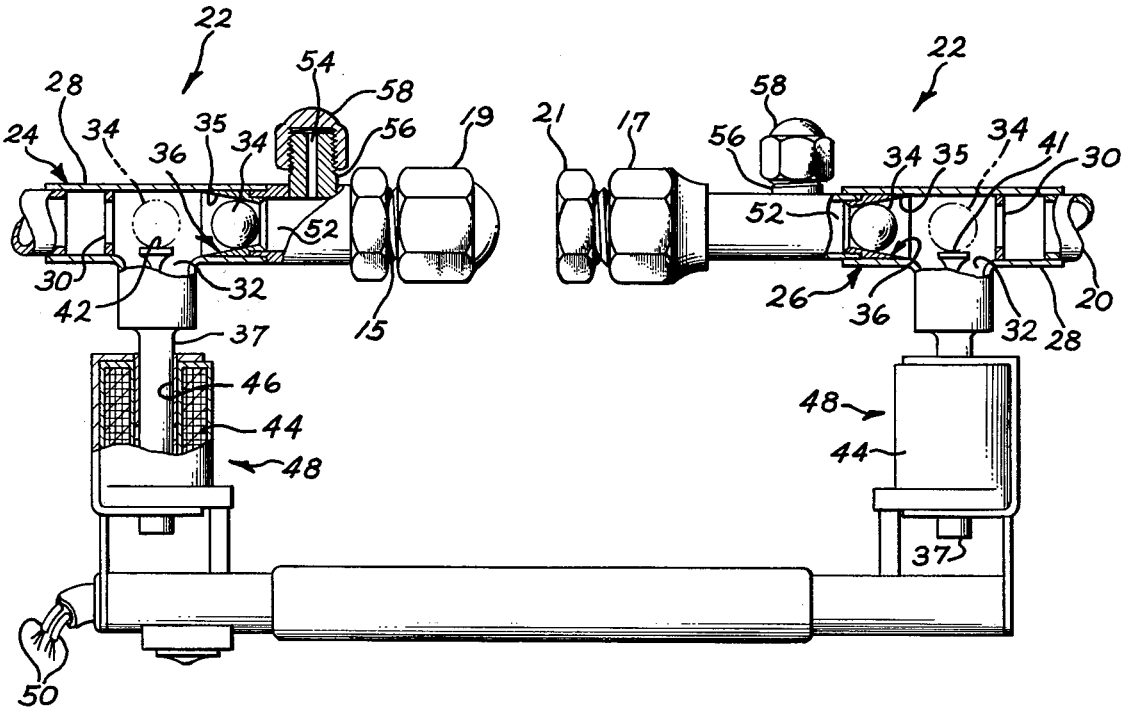
FIG. 3 is a view similar to FIG. 2 showing the parts positioned to be connected.

Both of the units 10 and 14 may be processed or purged and charged with refrigerant at the factory, and the inlet and outlet ends which may incorporate threaded male portions 15 (FIGS. 2 and 3) are sealed by suitable caps 19 (FIG. 3). It is also common practice that the interconnecting tubing 20 be charged with refrigerant and their ends incorporate threaded female nut portions 17 by suitable caps 21 (FIG. 3). Accordingly, when the units 10 and 14 are to be connected to each other by the tubing 20 to complete the refrigerant circuit, means must be provided that will maintain the charged condition of the system during the time the caps 19 and 21 are removed and the connections are made.

Accordingly, by the present invention, there is provided a valve system that may be employed at several positions or combinations of positions in the system.

Valves 22 are used in cooperating pairs as shown in FIGS. 1, 2 and 3 so that when a connection is broken or opened, a valve is arranged in each of the free ends. When convenient, the valve may be incorporated as part of the male, female connection employed between the units and the connecting tubing as illustrated.

The valves as employed are identical in construction and, accordingly, only one of the valves will be described in detail. However, the valves associated with the indoor and outdoor units will be designated 24, while the valves associated with the connecting tube members 20 will be designated 26.

A valve body or housing 28 includes a passageway 30 which provides a flow path for the refrigerant charge when it circulates through the valve 28. A valve retaining area 32 extending transverse to the passageway 30 is dimensioned to accommodate a ball valve member 34 in its inactivated or normally open position as shown in FIG. 2.

It should be noted that the valve body 28 is arranged so that the area 32 is always oriented in a position substantially below the passageway 30 so that the ball valve 34 in its normal or at-rest position is located in area 32 and out of the path of the refrigerant flow when present in the passageway 30.

In the valve closed position, as viewed in FIG. 3, the ball valve member 34 engages a valve seat 35 arranged in passageway 30 between the area 32 and the outlet end of the connection. To facilitate movement or the return of ball valve member 34 from its valve closed psoition to area 32, as shown in FIG. 2, a restoring force is provided to ball valve 34. To this end, an inclined surface area 36 is arranged from a position substantially at the tangent point between member 34 and seat 35, and the opening into area 32 so that the ball valve 34 will, in the absence of pressure in passageway 30, be restored by gravity to the area 32.

Means are provided for raising the ball valve member out of area 32 and into the passageway 30. To this end, a tubular member 37 (FIG. 2) having its passageway 38 communicating with area 32 is arranged on the bottom wall portion 39 of area 32. A plunger or activating member 40 is arranged for axial movement in the passageway 38 of member 37. The actuating member 40 has a head portion 42 which engages and supports the ball valve 34 in the raised position (FIG. 3). At the appropriate time in the connecting or disconnecting procedure, as will be explained fully hereinafter, an electrical coil 44 which is not part of a specific valve having a center core 46 is arranged on the member 37 so that a solenoid 48 is in fact completed with the plunger 40 being its movable armature.

Referring now to FIGS. 2 and 3, a typical connecting and disconnecting procedure will be explained. Assuming that the refrigerant line of one unit which includes a valve 24 will be joined to the end portion of one of the connecting tubes 20 which includes a valve 26

The first or initial step is to place coils 44 on the members 37 of the valves 24 and 26 involved in the connecting procedure, and then energizing the coils 44 in any suitable manner through conductors 50, so that the plungers or armatures 40 in each valve 24 and 26 raises the ball valves 34 into the cross sectional area of the passageway 30 as shown in broken lines in FIG. 3.

With the solenoids 48 so energized, and the ball valves in the passageway 30, the caps or seals 19 and 21 are removed from their respective connectors or valve portions 15 and 17. The attempted flow of refrigerant through passageway 30 immediately drives the ball valve 34 positioned in passageway 30 into engagement with the seat 35. The resulting leakage of refrigerant from the time the seal is broken by removal of parts 19 and 21 to the time the ball valve 34 reseals passageway 30 is small enough to be within the acceptable range. The sealed end portions of valves 24 and 26 are then connected by fastening the female nut 17 to the male portion 15 respectively to form a leak-free connection while the ball valve 34 is still seated on seat 35.

The final step in completing the connection is to cause the ball valve members 34 in the connected valves 24 and 26 to move from their respective valve seats 35 to the position shown in FIG. 2 so that the free flow of refrigeration is allowed through passageway 30 of the connection.

Means are provided to equalize the pressure between that of the refrigerant in the passageway 30 and that in the area or cavity 52 between the closed ball valves 34 of valves 24 and 26, so that the ball valve 34 will travel by gravity along the return surface 36 to their respective areas 32. To this end the valve body 28 includes a port 54 extending laterally from area 52. A tubular fitting 56 communicates with area 52 and provides a means for checking the pressure in area 52 by placing a pressure gauge (not shown) on the fitting. In addition, fitting 56 provides a means for purging the system as may be required during maintenance. A cap 58 is threaded on the exterior of the fitting to seal the fitting.

In carrying out the present invention, a refrigerant charge may be added into area 52 through port 54 that is sufficient to equalize the pressure between area 52 with that of passageway 30 so that the restoring force of gravity allows the ball valve to travel down the surface 36 and into area 32 as shown in FIG. 2, thereby completing a connection between one line of either section 10 or 14 and a connecting tube 20. While the addition of refrigerant charge is a quick effective way of equalizing the pressure between passageway 30 and area 52 to restore the ball valve 34 to area 32, time permitting, an allowed normal slow leakage of refrigerant past valve 34 will eventually cause the pressure of refrigerant in passageway 30 and area 52 to equalize, resulting in restoring ball valve 34. It should be noted that the above described connection may, as shown in FIG. 1, be arranged between both of the tubing members 20 and the inlet and outlet of both the units 10 and 14. At this time, with the connection completed, the coil 44 is removed from member 37.

In disconnecting the joint between the valves 24 and 26, it is only necessary to once again place the coils 44 on the member 37 and energize it to raise the ball valve 34 as shown in broken lines in FIG. 3. While the ball valve is held in its up position in the passageway 30, the portion 17 is disconnected from threaded end portion 15. As the refrigerant attempts to flow through passageway 30, it forces the ball valve 34 positioned in passageway 30 into engagement with its cooperating seat 35 to cut off refrigerant flow. At this time, the caps 19 and 21 are then placed on end portions 15 and 17 respectively.

While in the connecting procedure mention was made of a normal slow leakage of refrigerant past the ball valve 34 and seat 35, it should be understood that this leak when present is a controlled leak and may in fact not be present if so desired.

In summary, by the present invention, there is provided a system whereby a split unit air conditioner may be connected and/or disconnected without the use of expensive valving arrangements while preventing the leakage of refrigerant into the atmosphere. The system is economically feasable in that the valves operate under no load conditions and that the relatively expensive coil is not built into the units as a part of the system but is a tool supplied by the serviceman and applied to the refrigeration system only during the connecting or disconnecting process. The valves 24 and 26 are used together in combination as described above and the arrangement shown in FIG. 1 illustrates maximum usage of the valves in a split system.

While there has been shown and described a specific embodiment of the invention, it will be understood that it is not limited thereto and it is intended by the appended claims to cover all such modifications as fall within the true spirit and scope of the invention.

What is claimed is:

1. In a sealed split unit refrigerant charged air conditioning system including an indoor section and an outdoor section, each section having inlet and outlet ends being interconnected by tubing means, a charge retaining disconnectable valve assembly between each of said section ends and said tubing comprising:

cooperating pairs of valve means, each of said valve means including, a valve body having a passageway providing a flow path for said refrigerant between an inlet and outlet;

a valve member arranged in said body being movable between an open and closed position;

a valve retaining area communicating with said passageway being dimensioned to accommodate said valve member below the refrigerant flow path defined by said passageway;

a valve seat arranged between said retaining area and the outlet end of said passageway being dimensioned to accommodate said valve member in a sealing relationship;

actuating means associated with said valve member retaining area of each of said cooperating pairs of said valve means for simultaneously moving said valve member of said cooperating valve means upwardly out of said retaining area and into the refrigerant flow path of said passageway only for a time period sufficient to cause said valve members to move to their respective closed position on said seats when refrigerant flow is present to retain said charge, whereby said valve members are maintained in their closed position when pressure on the respective passageway side of said closed valves is greater than the pressure on the other side of said closed valves and said valve members being returned to their respective retaining area solely by the pressure on said other side which is equal to or greater than the pressure on said passageway side.

2. The valve assembly of claim 1 wherein means are provided between said valve seat and said retaining area for providing a restoring force to urge said valve member into said retaining area.

3. The valve assembly of claim 2 wherein said retaining area is transverse to and extending below said passageway.

4. The valve assembly of claim 3 wherein said actuating means includes a hollow member having a core extending axially from said valve retaining area, an activating member slidably mounted in said hollow member having its upper end in operating association with said ball valve, drive means associated with said hollow member for moving said activating member upwardly to raise said ball valve member out of said retaining area.

5. The valve assembly of claim 4 wherein said drive means includes an electric coil including a core dimensioned to receive said hollow member so that said activating member acts like an armature when said coil is energized to raise said ball valve out of said retaining area.

6. The valve assembly of claim 5 wherein said valve member is a ball valve.

7. A valving system for providing a disconnectable coupling between the end portions of conduits containing a fluid charge under pressure, a valve assembly in each of said end portions, comprising:

a valve body having a passageway providing a flow path for said fluid between an inlet and an outlet;

a valve member arranged in said body being movable between an open and closed position;

a valve retaining area communicating with said passageway being dimensioned to accommodate said valve member below the fluid flow path defined by said passageway;

a valve seat arranged in said passageway between said retaining area and said outlet end being dimensioned to accommodate said valve member in a sealing relationship;

actuating means including a housing communicating with said retaining area; an actuating member arranged for reciprocal movement in said housing including a portion arranged to engage said valve member in retaining area, a pair of driving means dimensioned to simultaneously be removably positioned on cooperating valve housing means, said actuating member of each valve assembly being activated to move its respective valve member out of its retaining area and into the fluid flow path of its passageway only for a time period sufficient to cause the valve members to move to their closed position when fluid flow is present to retain said charge, said valve members are maintained in their closed position when fluid pressure in their respective passageway side of said closed valve is greater than the fluid pressure on the other side of said closed valve, and said valve member being returned to said retaining area solely by the fluid pressure on said other side which is equal to or greater than the fluid pressure on said passageway side.

8. The valve assembly of claim 7 wherein said driving means is an electrical coil for inducing a field to impel said actuating member.

* * * * *